US005607245A

United States Patent [19]

Siwinski

[11] Patent Number: 5,607,245

[45] Date of Patent: Mar. 4, 1997

[54] WEB SUPPLY WITH NON-MOTORIZED AUTOMATIC REWIND FOR REMOVING SLACK IN THE WEB

[75] Inventor: Michael J. Siwinski, Rochester, N.Y.

[73] Assignee: Eastman Kodak Company, Rochester, N.Y.

[21] Appl. No.: 588,672

[22] Filed: Jan. 17, 1996

[51] Int. Cl.[6] ..... B41J 15/16

[52] U.S. Cl. ..... 400/614; 400/234; 400/120.01

[58] Field of Search ..... 400/218, 234, 400/614, 614.1, 120.01; 242/550, 410, 416, 592, 598.5

[56] References Cited

U.S. PATENT DOCUMENTS

| | | | |
|---|---|---|---|
| Re. 33,260 | 7/1990 | Stephenson | 346/76 |
| 1,945,981 | 2/1934 | Quinby | 242/592 |
| 4,669,678 | 6/1987 | Navarro | 242/67.3 |
| 4,712,113 | 12/1987 | Brooks et al. | 346/1.1 |
| 5,005,779 | 4/1991 | Ferguson | 242/410 |
| 5,162,815 | 11/1992 | Hodge | 346/76 |
| 5,176,458 | 1/1993 | Wirth | 400/120 |
| 5,260,716 | 11/1993 | Maslanka | 346/76 |

FOREIGN PATENT DOCUMENTS

| | | | |
|---|---|---|---|
| 59-204584 | 11/1984 | Japan | 400/218 |

*Primary Examiner*—Edgar S. Burr
*Assistant Examiner*—Daniel J. Colilla
*Attorney, Agent, or Firm*—Milton S. Sales

[57] ABSTRACT

A device is disclosed for pulling the web backward through a thermal print station between prints. A web advance mechanism is adapted to move web in opposed forward and reverse directions past the print station. A core upon which a web supply roll is spiral wound with an end of the web extending from the roll to the print station rests on a support having a high friction inclined surface. The inclined surface is oriented such that (i) advancement of the web past the print station in the forward direction tensions the web resulting in rotation of the core such that it climbs up the inclined surface and (ii) advancement of the web past the print station in the reverse direction causes the tension in the web to relax, resulting in rotation of the core by gravity such that it rolls down the inclined surface, whereby slack in the web is taken up by the roll.

8 Claims, 4 Drawing Sheets

FIG. 2
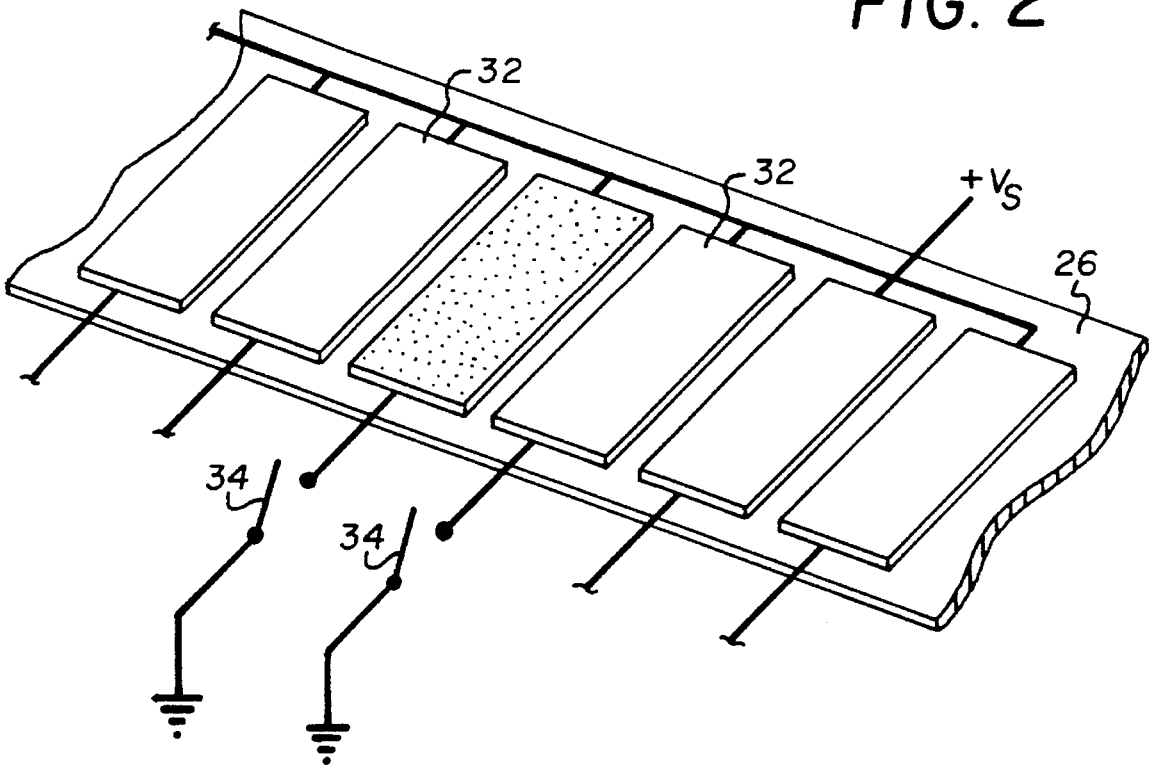
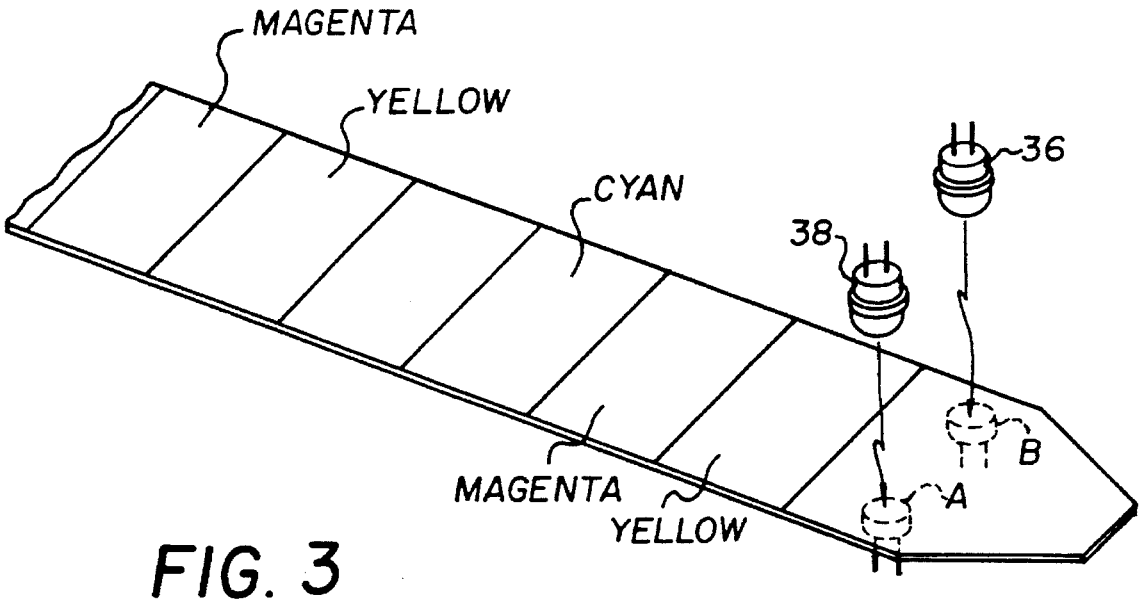
FIG. 3

WEB SUPPLY WITH NON-MOTORIZED AUTOMATIC REWIND FOR REMOVING SLACK IN THE WEB

BACKGROUND OF THE INVENTION

1. Technical Field

This invention relates generally to apparatus having a web drive mechanism for advancing web from a supply roll, and more particularly to such apparatus that returns some of the advanced web back toward the supply roll, wherein there is provided an non-motorized rewind mechanism for the supply roll to remove slack.

2. Background Art

The present invention is particularly useful in printer apparatus wherein a web of dye donor is advanced from a supply roll, past a thermal printhead, to a motorized take-up roll. Referring to FIG. 1, a commercially available thermal printer 10 includes a printhead assembly 12, dye donor web supply and take-up rolls 14 and 16, respectively, a roller platen assembly 18, a pair of pinch rollers 20 and 22, a dye receiver medium transport guide 30, and a dye receiver medium supply 24.

Normal thermal printer operations include loading dye receiver medium, printing information upon the dye receiver medium and ejecting the finished print. Each of these operations is fully described in commonly-assigned U.S. Pat. No. 5,176,458, which issued to H. G. Wirth on Jan. 5, 1993. Therefore only a brief description will be herein given of the illustrated embodiment of the thermal printer.

Printer operation begins with a loading phase, in which a sheet 28 of dye receiver medium advances from supply 24 along guide 30 to a gap between printhead assembly 12 and platen assembly 18. The leading edge of sheet 28 is held in the nip of rollers 20 and 22. Printhead assembly 12 moves toward platen assembly 18, pressing dye donor web 26 and the dye receiver medium against platen assembly 18 to form a sandwich for thermal printing.

Referring to FIG. 2, the printhead of printhead assembly 12 includes a plurality of heating elements 32, such as electrical resistors. When one of a plurality of switches 34 is closed, the associated heating element 32 is connected to a voltage potential source $V_S$.

Dye donor web 26 comprises a leader portion followed by a repeating series of dye frames. The dye frames may be contiguous as shown or spaced by interframe regions, and, as shown in FIG. 3, each series includes in sequence yellow, magenta, and cyan dye frames. A single series is of course used to print one full-color image, comprising multiple color planes, on dye receiver medium 28.

As shown, there are two LEDs 36 and 38 which illuminate the dye donor web from above. LED 36 emits yellow light and LED 38 emits red light. Two photodetectors "A" and "B" are disposed below the dye donor web and receive light which passes through the dye donor web. Photodetectors "A" and "B" provide a signals for identifying the start of series and each individual color dye frame in such series. For a more complete discussion of this identification, reference is made to commonly assigned Reissue U.S. Pat. No. Re. 33,260 to S. Stephenson.

FIGS. 4 and 5 schematically illustrate the position of the dye donor web frames before and after LED 36 (schematically shown in these figures) have detected the transition between a used and an unused dye frame 40 and 42, respectively. If the printer is powered down in the position of FIG. 5, and then powered up while the web is in the position of FIG. 5, the printer logic cannot be sure where the frame transition is. Since the web drive is unidirectional (arrow 44), the printer must advance the web forward until it sees the next web frame transition into the first (yellow) frame. Doing so will waste one series of donor frames.

DISCLOSURE OF THE INVENTION

It is an object of the present invention to provide an inexpensive device for pulling the web backward so that the frame transition passes through the LED detection position, whereby the web will be left in the position shown in FIG. 4 when the printer is powered down. When the printer is again powered up with a used dye frame between the LEDs and the photodetectors, the printer can advance the web to the next unused frame without wasting a series of frames.

According to a feature of the present invention, a printer includes a print station and a web advance mechanism adapted to move web in opposed forward and reverse directions past the print station. A core upon which a web supply roll is spiral wound with an end of the web extending from the roll to the print station rests on a support having a high friction inclined surface. The inclined surface is oriented such that (i) advancement of the web past the print station in the forward direction tensions the web resulting in rotation of the core such that it climbs up the inclined surface and (ii) advancement of the web past the print station in the reverse direction causes the tension in the web to relax, resulting in rotation of the core by gravity such that it rolls down the inclined surface, whereby slack in the web is taken up by the roll.

According to features of preferred embodiments of the present invention, the high friction inclined surface may be formed of a rubber coating on the support, of a rough surface on the support, or of a gear teeth on the support with matching gear teeth on the core adapted to engage the gear teeth on the support.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 2 is a schematic perspective of several heating elements used in the printhead of the printer of FIG. 1;

FIG. 3 shows a portion of a typical dye donor web;

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art. While the description illustrates the present invention as it would be used in a thermal printer, it will be understood that aspects of the invention are applicable to web advance systems which provide for rewind of the web other than printers.

Figure 1:
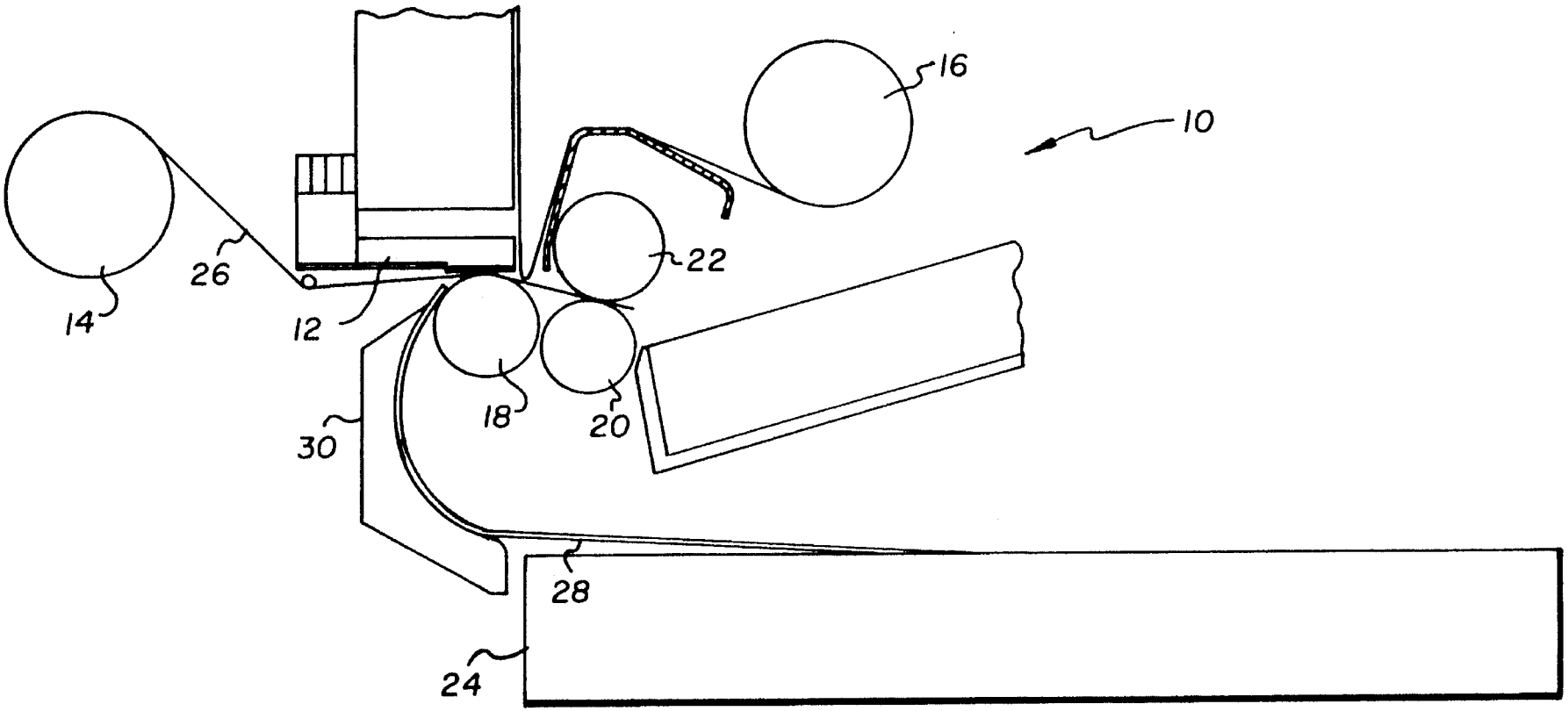
FIG. 1 is a schematic of a thermal printer which can be employed to make color images in a dye receiver medium in accordance with this invention.
Figure 6:
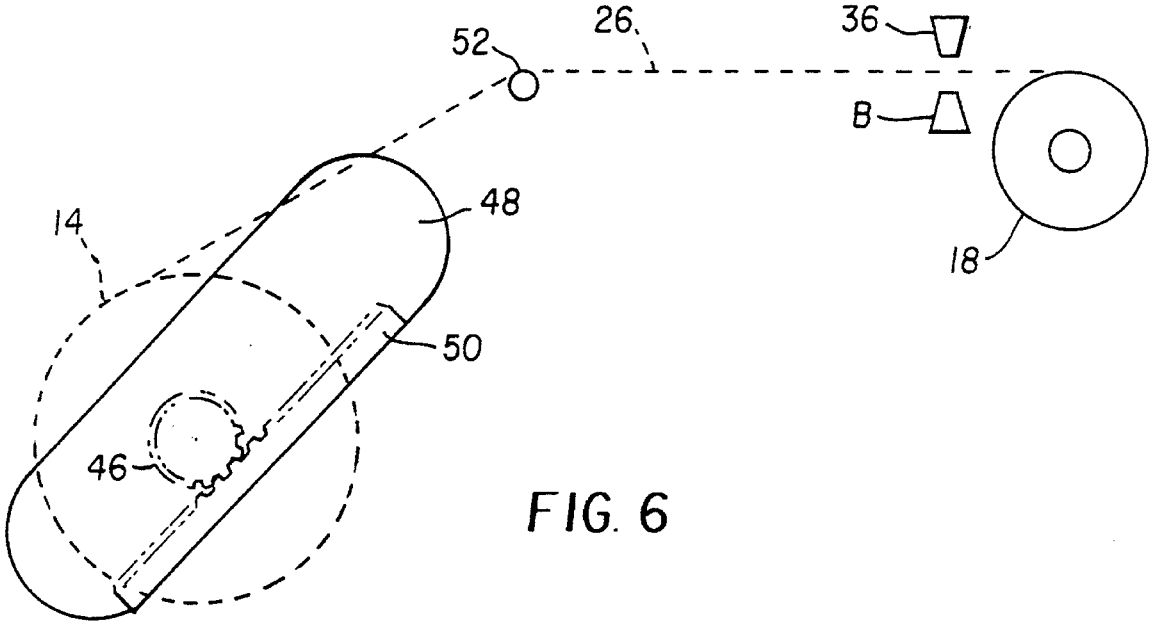
FIGS. 6–8 schematically show details of the printer of FIG. 1, illustrating different stages during operation of the printer according to the present invention.

The elements schematically shown in FIG. 6 include dye donor web supply roll 14 and roller platen assembly 18. The two emitter/detector pairs 36/"B" and 38/"A" (not shown)are disposed about dye donor web 26, respectively. The dye donor web is pulled past printhead 12 (FIG. 1) by a unidirectional donor drive motor, not shown.

Web supply roll 14 is carried on a cylindrical core 46. The ends of core 46 extend beyond the ends of roll 14 and are received in respective angled slots 48. Only one slot is illustrated in the drawings, the other slot being aligned with and behind the illustrated slot. Each slot is wider than the diameter of core 46, and the lower portion of the lower edge of at least one of the slots is provided with a high friction surface 50. Preferably, the upper portion of the lower edge of the slots are not provided with the high friction surface. The high friction surface may be, for example, rubber or other high friction material, a molded or machined rough surface, or gear teeth manufactured into the lower edge of the side wall with corresponding gear teeth molded into core 46.

While the printer is idle, the supply roll core rests on the high friction surface, near the bottom of slot 48. A web support pin 52 keeps the web positioned between the emitter/detector pair when the supply roll is positioned near the bottom of slot 48.

Figure 7:
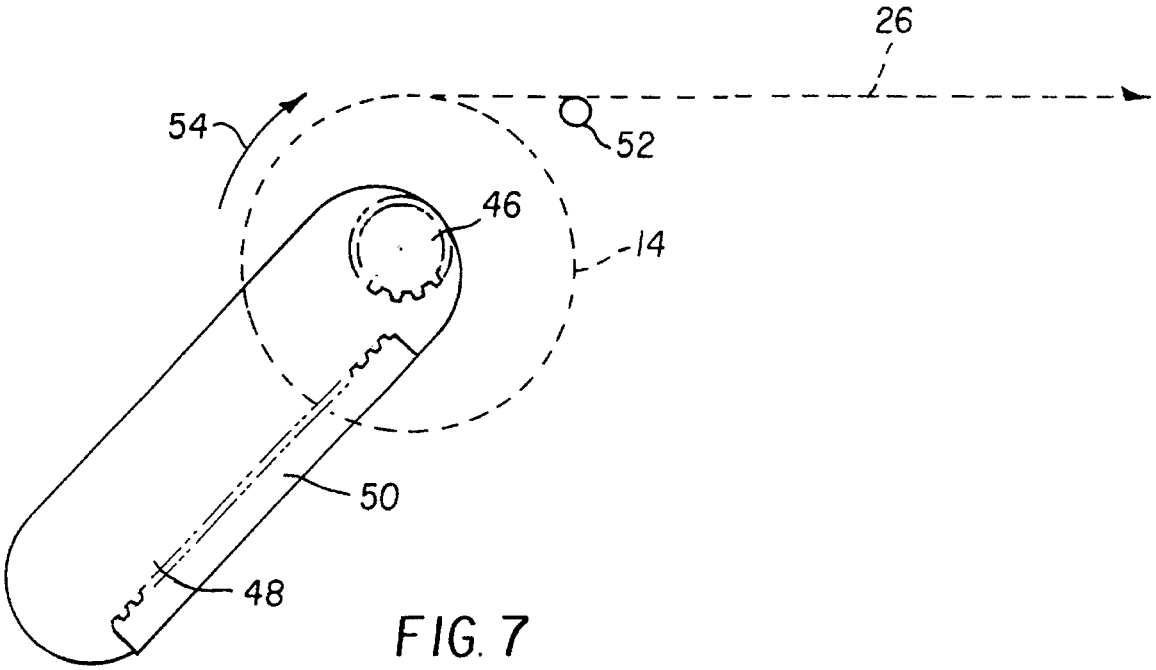

FIG. 7 depicts the position of the supply roll during printing operations. As dye donor web is pulled off of supply roll 14, high friction surface 50 prevents the roll from sliding up the inclined surface of the slot. Rather, the roll will rotate in the direction of arrow 54, causing the supply roll to "climb" up the incline of slot 48 until the core is pulled to the upper portion of the slot, where it is no longer in contact with high friction surface 50. The forward tension of the web will keep core 46 at the top of the slot, where the relatively low amount of friction will allow the printer to pull unused donor web off of the roll.

Figure 4:
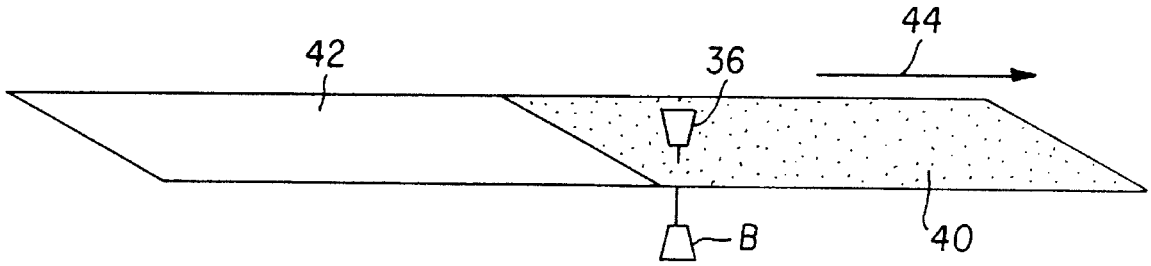
FIGS. 4 and 5 schematically show different positions of the dye donor web frames during operation of the printer of FIG. 1.
Figure 5:
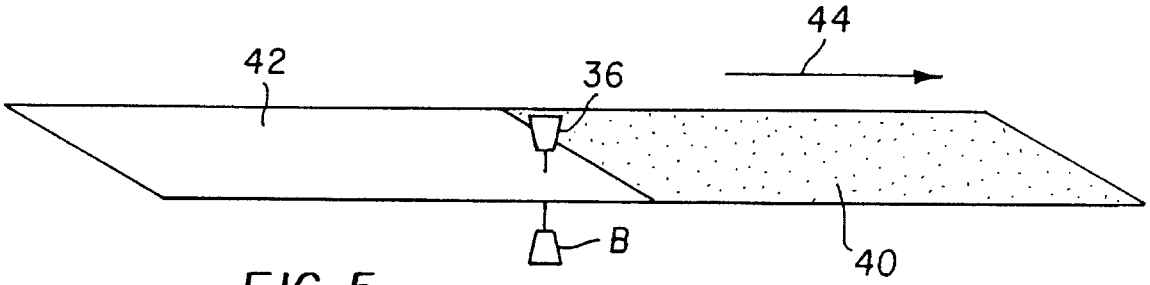

When the printer is finished printing the last frame, the donor web is positioned as shown in FIG. 5. The printer runs platen 18 backwards for a small amount. This pulls a small length of used donor web from take-up roll 16 so that the interface between the last frame of the used series of frames and the first frame of the next, unused series moves to the supply side of the emitter/detector pair, as shown in FIG. 4.

Figure 8:
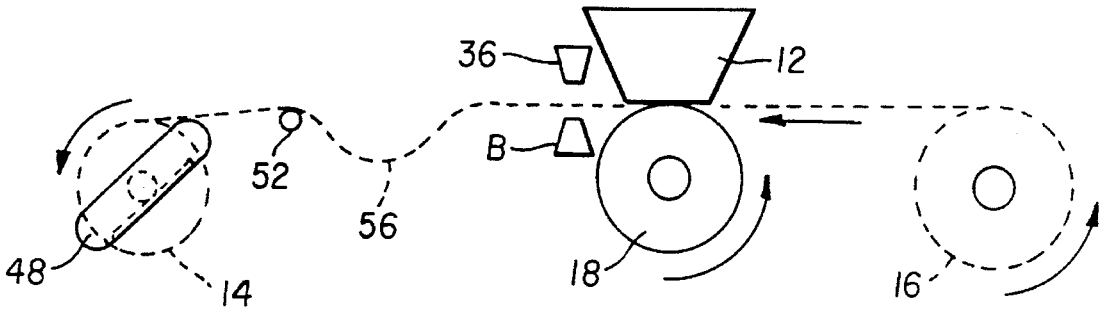

During rewind, any small amount of slack in the web, which would tend to form (FIG. 8) between the printing nip and the supply roll, must be prevented; as space is generally not available for forming a loop 56 of slack web. Accordingly, the present invention provides that supply roll 16 will roll down the high friction surface of the inclined slot, and take up the web slack as it is created. Because of the difference in diameters of the outer circumference of the supply roll and of its core, there is a length magnification that allows the supply roll to rewind a length of web that is longer than the distance that the roll travels down the incline of the slot. After the web is pulled back through the emitter/detector pair, the donor will once again come to rest in the position shown in FIG. 6.

The invention has been described in detail with particular reference to preferred embodiments thereof, but it will be understood that variations and modifications can be effected within the spirit and scope of the invention.

What is claimed is:

1. A printer comprising:

a print station;

a web advance mechanism adapted to move a web in opposed forward and reverse directions past the print station;

a core upon which a web supply roll is spiral wound, an end of the web extending from the roll to the print station;

a support defining a high friction inclined surface upon which the core rests, said inclined surface being oriented such that (i) advancement of the web past the print station in the forward direction tensions the web resulting in rotation of the core such that it climbs up the inclined surface and (ii) advancement of the web past the print station in the reverse direction causes the tension in the web to relax, resulting in rotation of the core by gravity such that it rolls down the inclined surface, whereby slack in the web is taken up by the roll.

2. A printer as defined in claim 1 wherein the high friction inclined surface comprises a rubber coating on the support.

3. A printer as defined in claim 1 wherein the high friction inclined surface comprises a rough surface on the support.

4. A printer as defined in claim 1 wherein:

the high friction inclined surface comprises a gear teeth on the support; and the core comprises gear teeth adapted to engage the gear teeth on the support.

5. A printer as defined in claim 1 wherein the support defines a slot which carries an end of the core; and the high friction inclined surface comprises a surface of the slot.

6. A printer as defined in claim 1 wherein the support defines a low friction inclined surface above the high friction inclined surface, said low friction inclined surface being oriented such that continued advancement of the web away from the roll after the core rolls into contact with the low friction inclined surface causes tension in the web resulting in rotation of the core without further climbing.

7. A printer as defined in claim 1 wherein:

the web supply roll is formed of dye thermal donor web; and the print station includes a resistive element thermal print head.

8. A thermal printer comprising:

a print station having a resistive element thermal printhead;

a web advance mechanism adapted to move a dye donor web having repeating series of different color dye frames in opposed forward and reverse directions past the print station;

means for identifying the start of each series at a predetermined location relative to the printhead;

a core upon which a web supply roll is spiral wound, an end of the web extending from the roll to the print station;

a support defining a high friction inclined surface upon which the core rests, said inclined surface being oriented such that (i) advancement of the web past the print station in the forward direction tensions the web resulting in rotation of the core such that it climbs up the inclined surface and (ii) advancement of the web past the print station in the reverse direction causes the tension in the web to relax, resulting in rotation of the core by gravity such that it rolls down the inclined surface, whereby slack in the web is taken up by the roll.

* * * * *